US010890182B2

(12) United States Patent
Lee

(10) Patent No.: US 10,890,182 B2
(45) Date of Patent: Jan. 12, 2021

(54) SCROLL COMPRESSOR HAVING CHECK VALVE AND PASSAGE THAT COMMUNICATES A DISCHARGE PORT WITH A DISCHARGE SPACE WHEN THE CHECK VALVE IS CLOSED

(71) Applicant: LG ELECTRONICS INC., Seoul (KR)

(72) Inventor: Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 391 days.

(21) Appl. No.: 15/849,853

(22) Filed: Dec. 21, 2017

(65) Prior Publication Data

US 2018/0202440 A1 Jul. 19, 2018

(30) Foreign Application Priority Data

Jan. 18, 2017 (KR) ..... 10-2017-0008808

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0261* (2013.01); *F04C 18/0269* (2013.01);
(Continued)

(58) Field of Classification Search
CPC ..... F04C 18/0215; F04C 18/0261; F04C 18/0269; F04C 23/008; F04C 29/06;
(Continued)

(56) References Cited

U.S. PATENT DOCUMENTS 4,995,789 A * 2/1991 Fujio ..... F04C 23/008 417/360
5,699,786 A * 12/1997 Oshima ..... A61M 11/06 128/200.21
(Continued)

FOREIGN PATENT DOCUMENTS

JP 2002349458 A * 12/2002 ..... F04C 29/128
KR 10-2016-0020190 2/2016

OTHER PUBLICATIONS

English Machine Translation of JP 2002-349458A translated by Espacenet on Jun. 25, 2020 (Year: 2002).*
(Continued)

*Primary Examiner* — Patrick Hamo
*Assistant Examiner* — Paul W Thiede
(74) *Attorney, Agent, or Firm* — Ked & Associates LLP

(57) ABSTRACT

A scroll compressor is provided that may include a casing, a drive motor, a rotational shaft, a frame provided at a lower side of the drive motor, a first scroll provided at a lower side of the frame, a second scroll provided between the frame and the first scroll and including a compression chamber provided between the first scroll and the second scroll, and a first check valve provided at an exit end of the discharge port to prevent refrigerant discharged to the inner space of the casing from flowing back to the compression chamber. A communication path may be provided at the exit end of the discharge port to communicate the inner space of the casing with the compression chamber when the first check valve is closed to cause refrigerant to flow back to the compression chamber, enabling a quick flat pressure state to be made.

14 Claims, 10 Drawing Sheets

(51) Int. Cl.
*F04C 29/12* (2006.01)
*F04C 29/06* (2006.01)

(52) U.S. Cl.
CPC ..... *F04C 23/008* (2013.01); *F04C 29/12* (2013.01); *F04C 29/128* (2013.01); *F04C 29/06* (2013.01)

(58) Field of Classification Search
CPC ..... F04C 29/12; F04C 29/128; F04C 29/124; F04C 18/0207
USPC ..... 418/55.1–55.6, 270; 137/856; 417/410.1, 223
See application file for complete search history.

(56) References Cited

U.S. PATENT DOCUMENTS 6,077,048 A * 6/2000 Okada ..... F16D 43/2026 417/223
6,095,764 A * 8/2000 Shibamoto ..... F04C 29/126 417/310
2014/0102666 A1* 4/2014 Ichishi ..... B60H 1/00828 165/11.1
2016/0047378 A1* 2/2016 Choi ..... F04C 18/0215 418/55.1

OTHER PUBLICATIONS

English Abstract of JP 2002-349458A from USPTO Derwent Database (Year: 2002).*

* cited by examiner

SCROLL COMPRESSOR HAVING CHECK VALVE AND PASSAGE THAT COMMUNICATES A DISCHARGE PORT WITH A DISCHARGE SPACE WHEN THE CHECK VALVE IS CLOSED

CROSS-REFERENCE TO RELATED APPLICATION(S)

This application claims priority under 35 U.S.C. § 119 to Korean Application No. 10-2017-0008808, filed on Jan. 18, 2017, whose entire disclosure(s) is/are hereby incorporated by reference.

BACKGROUND

1. Field

A scroll compressor is disclosed herein.

2. Background

A scroll compressor is a compressor which is provided with a fixed scroll provided in an inner space of a casing, and an orbiting scroll engaged with the fixed scroll to perform an orbiting motion so as to form a pair of compression chambers, each of which includes a suction chamber, an intermediate pressure chamber, and a discharge chamber, between a fixed wrap of the fixed scroll and an orbiting wrap of the orbiting scroll. Compared with other types of compressors, the scroll compressor is widely used for refrigerant compression in an air-conditioning apparatus, for example, by virtue of advantages of obtaining a relatively high compression ratio and stable torques resulting from smoothly-performed suction, compression, and discharge strokes of a refrigerant. Recently, a high performance scroll compressor having an operation speed of more than 180 Hz by reducing an eccentric load have been developed.

Scroll compressors may be classified into a low pressure type in which a suction pipe communicates with an inner space of the casing and a high pressure type in which the suction pipe directly communicates with the compression chamber. In a case of the low pressure type scroll compressor, the inner space of the casing is classified into a suction space as a low pressure part and a discharge space as a high pressure part, and in a case of the high pressure type scroll compressor, an inner space of the casing forms the discharge space which is a high pressure part.

Further, scroll compressors are provided with a discharge port at a fixed scroll and a check valve at an end of the discharge port, irrespective of the type of the scroll compressor. Accordingly, compressed refrigerant is discharged to an inner space of the casing forming a discharge space by opening the check valve when the compressor is operated, while in a state that the compressor is not operated, the refrigerant discharged to the inner space from the compression chamber is prevented from flowing back to the compression chamber by closing the check valve by a pressure within the inner space, thereby preventing the orbiting scroll from being reversely rotated.

Furthermore, compressors may be classified into an upper part compression type and a lower part compression type according to a position of a drive unit and compression unit, and the upper part compression type is the type that the compression unit is located at an upper part, but when the drive unit is located at a lower part, it may be called a lower part compression type. In such upper and lower part compression types, it is generally identical to provide the check valve at an end of the discharge port. For instance, a lower part compression type scroll compressor is disclosed in Korea patent Laid-open Publication No. 10-2016-0020190, which is hereby incorporated by reference.

However, in such type of scroll compressors, when a check vale is installed at a discharge port of a compression part, it is advantageous to prevent a reverse rotation of an orbiting scroll by cutting off a backflow of refrigerant, which has already been discharged, to the compression part when the compressor is stopped, but it may cause an adverse effect to prevent producing a pressure equilibrium between the discharge space and the compression chamber by cutting off an introduction of the high pressure refrigerant discharged to the inner space into a relatively low pressure compression part, that is, a compression chamber. Thus, when the compressor is restarted, it takes a considerable time to discharge the compressed refrigerant while pushing out the check valve by the pressure within the compression chamber overcoming the pressure within the discharge space and an elastic force of the check valve. Thus, restarting of the compressor may fail, thereby resulting in deterioration in efficiency and reliability of the compressor.

Further, when the check valve is installed at the discharge port of the compression part, the refrigerant of intermediate pressure, which has been compressed at the compression part, may flow back toward the suction pipe when the compressor is stopped, so that a pressure difference between a condenser and an evaporator may be decreased. This may result in a decrease in efficiency of a refrigeration cycle apparatus as the latent heat of the refrigeration cycle apparatus is low, though the fan of the refrigeration cycle is operated while the compressor is stopped.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
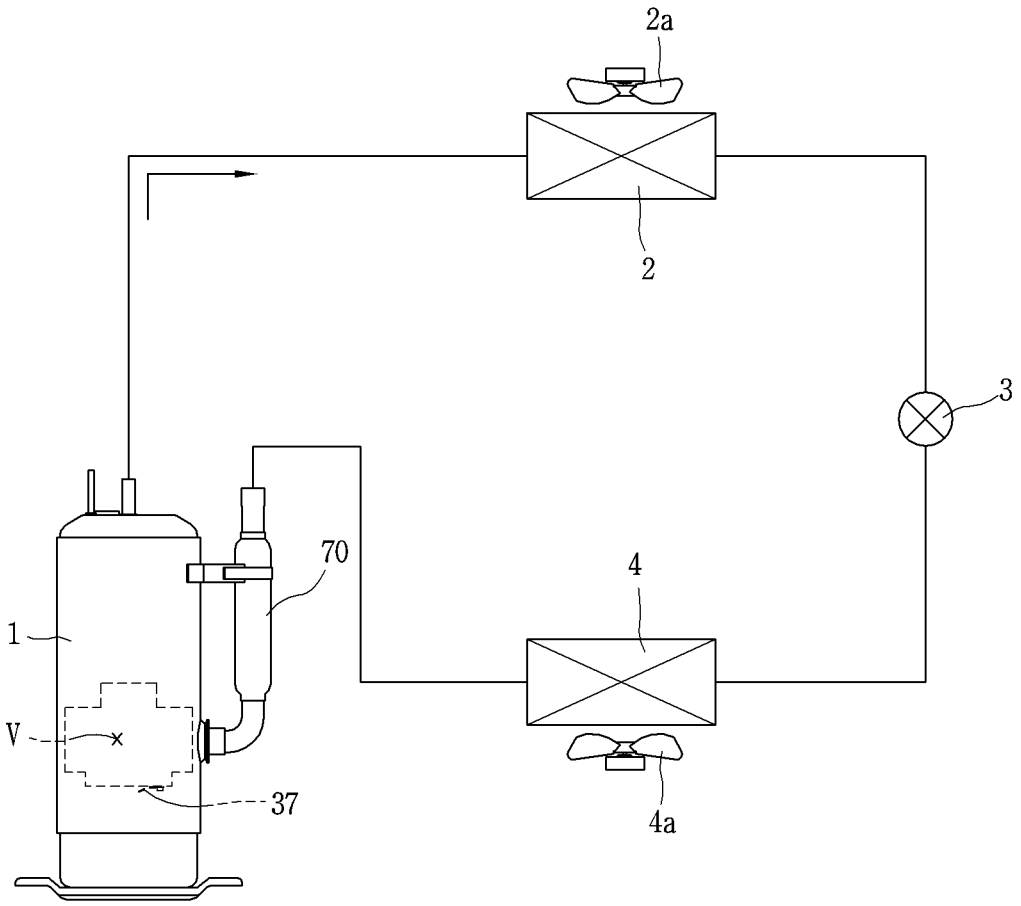
FIG. 1 is a schematic diagram illustrating a refrigeration cycle apparatus to which a scroll compressor according to an embodiment is applied.

Description will now be given of a scroll compressor according to embodiments disclosed herein, with reference to the accompanying drawings. Where possible, like reference numerals have been used to indicate like elements and repetitive disclose has been omitted.

Figure 2:
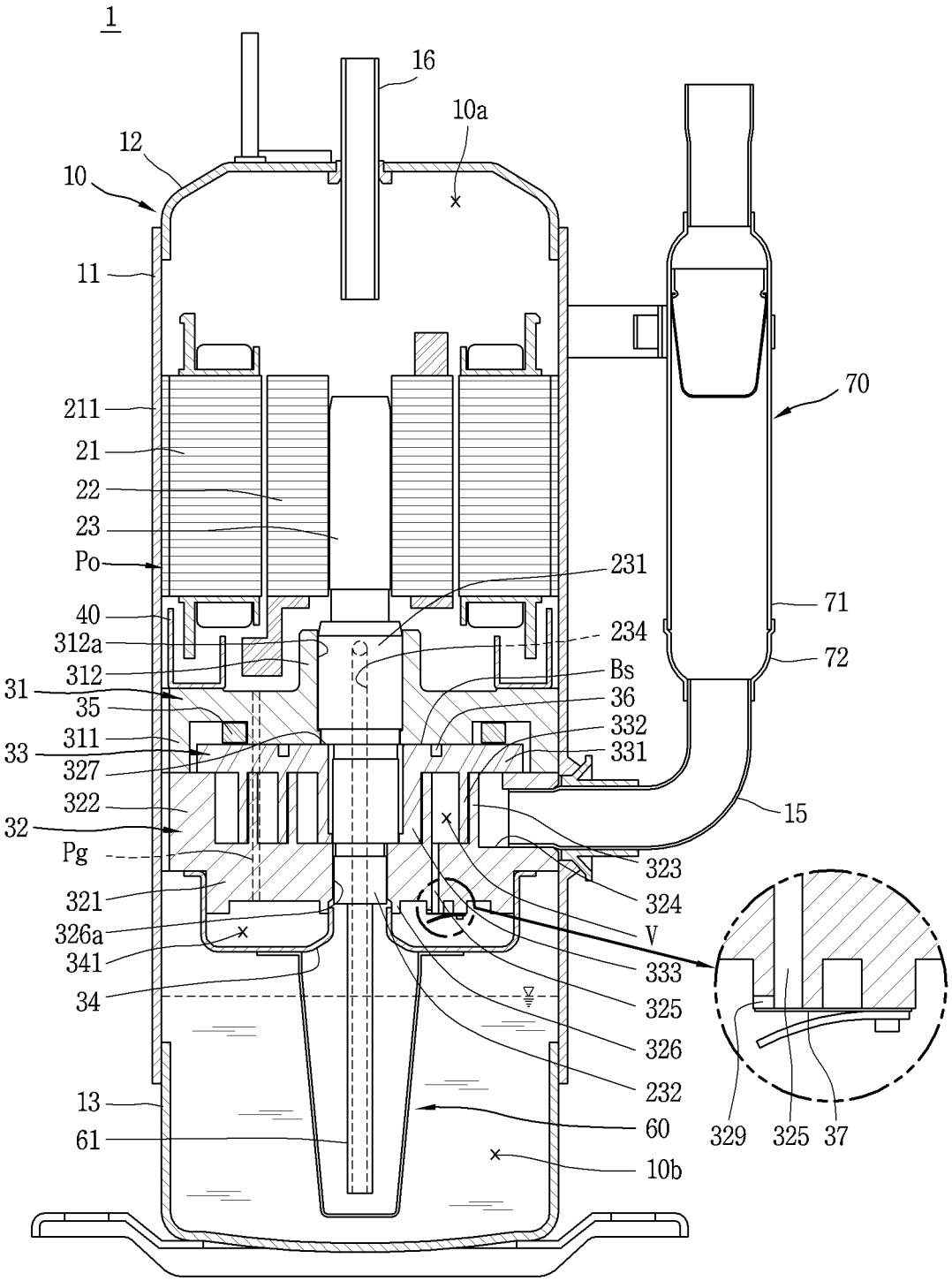
FIG. 2 is a longitudinal sectional view illustrating one example of a lower part compression type scroll compressor according to an embodiment.
Figure 3:
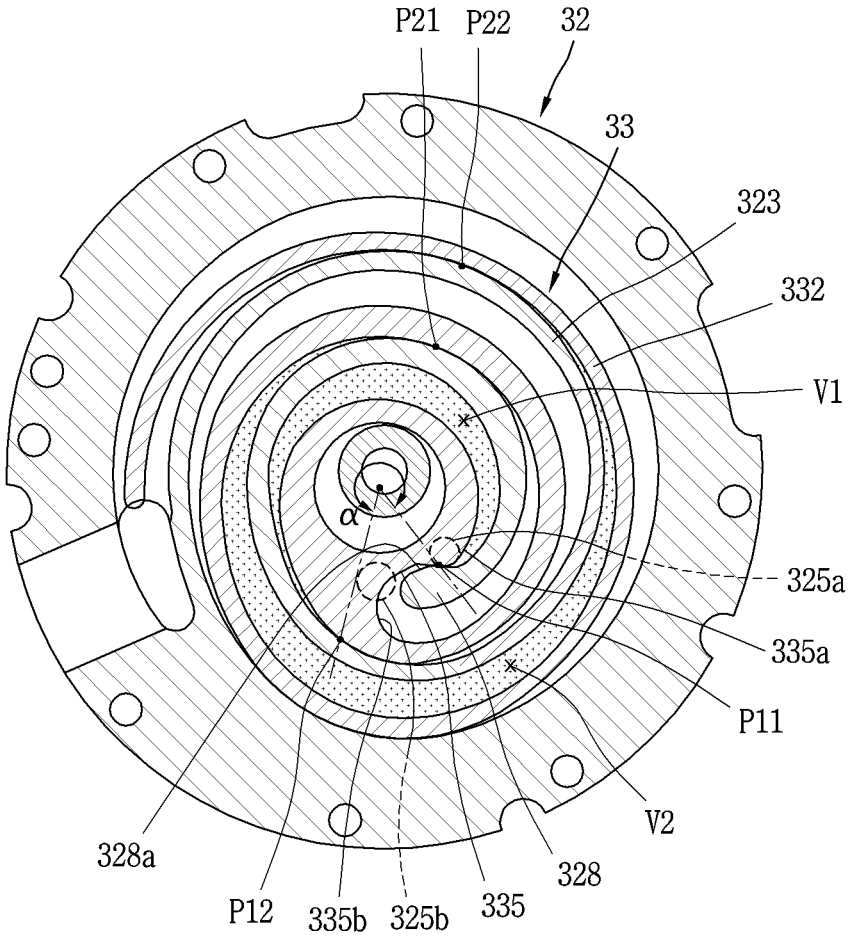
FIG. 3 is a cross sectional view illustrating a compression part of the scroll compressor of FIG. 2.

FIG. 1 is schematic a diagram illustrating a refrigeration cycle apparatus to which a scroll compressor according to an embodiment is applied. FIG. 2 is a longitudinal sectional views illustrating one example of a lower part compression type scroll compressor according to an embodiment. FIG. 3 is a cross sectional view illustrating a compression part of the scroll compressor of FIG. 2.

Referring to FIG. 1, the refrigeration apparatus to which a scroll compressor according to an embodiment is applied, may be configured as a closed loop by a compressor 1, a condenser 2 and a condensing fan 2*a*, an expander 3, and an evaporator 4 and an evaporating fan 4*a*.

The compressor 1 may include a motor part or motor 20 having a drive motor disposed within an inner space 10*a* of a casing 10 forming a discharge space, and a compression part or portion 30 disposed at a lower side of the motor part 20 and configured to compress refrigerant by a rotational force from the motor part 20.

The casing 10 may include a cylindrical shell 11 forming a hermetic container, an upper shell 12 that covers an upper portion of the cylindrical shell 11 and forms the hermetic container together with the cylindrical shell 11, and a lower shell 13 that covers a lower portion of the cylindrical shell 11 and forms the hermetic container together with the cylindrical shell 11 and forms an oil storage space 10*b* as well.

A refrigerant suction pipe 15 may directly communicate with a suction chamber of the compression part 30 in a penetration manner at a side of the cylindrical shell 11, and a refrigerant discharge pipe 16, which communicates with an inner space 10*a* of the casing 10, may be installed at an upper portion of the upper shell 12. The refrigerant discharge pipe 16 corresponds to a passage where the compressed refrigerant discharged to the inner space 10*a* of the casing 10 is discharged to outside, and an oil separator (not shown) that separates oil mixed in the discharged refrigerant may be connected to the refrigerant discharge pipe 16.

A stator 21 of the motor part 20 may be installed at an upper portion of the casing 10, and a rotor 22 forming the motor part 20 together with the stator 21 may be disposed within the stator 21 so as to be rotatable by interaction with the stator 21. The stator 21 may include at its inner circumferential surface a plurality of slots (not numbered) in a circumferential direction in which a coil may be wound, and at its outer circumferential surface an oil collecting passage 211, through which oil passes, may be provided between an inner circumferential surface of the cylindrical shell 11, by being formed in a D-cut shape.

A main frame 31 may be fixedly coupled to an inner circumferential surface of the casing 10 at a lower portion of the stator 21 with a predetermined space to form the compression part 30. The main frame 31 may be fixedly coupled to an inner circumferential surface of the cylindrical shell 11 by, for example, a shrinkage fitting or welding with its outer surface.

The main frame 31 may include a ring shaped frame side wall part or wall 311 (hereinafter, referred to as a "first side wall part" or "first side wall") at its border, and a first shaft support 312 that supports a main bearing 231 of a rotational shaft 23, which will be described hereinafter, at its center. The first shaft support 312 may include a first shaft support hole 312*a* through which the main bearing 231 of the rotational shaft 23 is rotatably inserted and supported in a radial direction may be formed to penetrate in an axial direction.

A fixed scroll 32 (hereinafter, referred to as a "first scroll") may be installed at a bottom surface of the frame 31, leaving an orbiting scroll 33 (hereinafter, referred to as a "second scroll") eccentrically coupled to the rotational shaft 23 therebetween. The first scroll 32 may be fixedly coupled to the main frame 31, but may be coupled to be movable in the axial direction.

The first scroll 32 may include a fixed plate portion or plate 321 (hereinafter, referred to as a "first plate portion" or "first plate") formed in a substantially circular plate shape, and a scroll side wall portion 322 (hereinafter, referred to as a "second side wall portion" or "second wide wall") coupled to a bottom edge portion or bottom edge of the main frame 31 and formed at an edge of the first plate portion 321.

The first plate portion 321 may include at its upper surface a fixed wrap 323 (hereinafter, referred to as a "first wrap") which forms a compression chamber (V) by engaging with the orbiting wrap 332 (hereinafter, referred to as a "second wrap"), which will be described hereinafter. The compression chamber (V) may be formed between the first plate portion 321 and the first wrap 323 and between the second wrap 332, which will be described hereafter, and a second plate portion or plate 331, and may include a suction chamber, an intermediate pressure chamber and a discharge chamber consecutively.

The compression chamber (V) may include a first compression chamber (V1) formed between an inner surface of the first wrap 323 and an outer surface of the second wrap 332, and a second compression chamber (V2) formed between an outer surface of the first wrap 323 and an inner surface of the second wrap 332. That is, as shown in FIG. 3, the first compression chamber (V1) may be formed between two contact points P11 and P12 formed by contacting an inner surface of the first wrap 323 with an outer surface of the second wrap 332, and an angle $\alpha$ between two lines connecting a center (O) of an eccentric part or portions with the two contacting points P11 and P12, respectively, where $\alpha<360°$ may be obtained, at least before starting a discharge. Further, the second compression chamber (V2) may be formed between two contact points P21 and P22 formed by contacting an outer surface of the first wrap 323 with an inner surface of the second wrap 332.

Thus, the first compression chamber (V1) suctions refrigerant earlier than the second compression chamber (V2) and has a long compression path compared to the second compression chamber (V2), but as the second wrap 332 is formed to have an irregularity, a compression ratio of the first compression chamber (V1) is relatively lower than a compression ratio of the second compression chamber (V2). Further, the second compression chamber (V2) suctions refrigerant later than the first compression chamber (V1) and has a long compression path compared to the second compression chamber (V2), but as the second wrap 332 is formed to have an irregularity, the compression ratio of the second compression chamber (V2) is relatively higher than the compression radio of the first compression chamber (V1).

Further, a suction hole 324 that communicates with the refrigerant suction pipe 15 may be formed at one side of the second side wall 322 in a penetration manner, and at a center of the first plate portion 321, a discharge port 325 through which the compressed refrigerant is discharged and communicating with the discharge chamber may be formed. The discharge port 325 may be singly provided so as to be communicate with both the first compression chamber (V1) and the second compression chamber (V2), or may include a plurality so as to independently communicate with each compression chamber (V1 or V2), respectively.

A first check valve 37 to open or close the discharge port 325 may be installed at an exit end of the discharge port 325. The first check valve 37 may be opened by a pressure difference when the compressor is operated in a normal state, such that the refrigerant compressed in the compression chamber (V) is discharged to an inner space 341 of a discharge cover 34 while pushing the first check valve 37, whereas when the compressor is stopped, the check valve 37 is closed such that a backflow of the refrigerant discharged to the inner space 341 of the discharge cover 34 to the compression chamber (V) may be prevented.

The first check valve 37 may be fixed to the first scroll 32 at one or a first end and the other or a second end may be kept free with respect to the first scroll 32. The free end of the first check valve 37 may include an open/close part or portion having a diameter larger than an inner diameter of the discharge port 325.

At a center of the first scroll 32, a second shaft support 326 that supports a sub-bearing 232 of the rotational shaft 23, which will be described hereinafter, may be provided, and at the second shaft support 326, a second shaft support hole 326*a* may be formed in an axial direction to support the sub-bearing 232 in the radial direction.

A thrust bearing portion or bearing 327 that supports the rotational shaft 23 in the axial direction may be provided between the first plate portion 321 of the first scroll 32 and a bottom surface of an eccentric portion 233 of the rotational shaft 23, which will be described hereinafter.

The discharge cover 34 that accommodates therein and guides the refrigerant discharged from the compression chamber (V) to a refrigerant flow path, which will be described hereinafter, may be coupled to a lower part or portion of the first scroll 32. The discharge cover 34 may be formed so as to accommodate in the inner space 341 the discharge port 325, and at the same time to accommodate an inlet of a refrigerant flow path ($P_G$) that guides the refrigerant discharged from the compression chamber (V) to the inner space 10*a* of the casing 10.

The refrigerant flow path ($P_G$) may be formed to penetrate the second side wall 322 of the first scroll 32 and the first side wall 311 of the main frame 31 inside a flow separation part or portion 40 in order, or may be formed to be recessed consecutively at an outer surface of the second side wall 322 and an outer surface of the first frame 311.

The second scroll 33 may be installed to be orbited between the main frame 31 and the first scroll 32. An Oldham ring 35 may be provided between an upper surface of the second scroll 33 and a bottom surface of the main frame 31 corresponding thereto to prevent a self-rotation of the second scroll 33, and a sealing member 36 that forms a back pressure chamber (Bs) may be provided at an inner portion over the Oldham ring 35. Thus, the back pressure chamber (Bs) may be formed by a space which is formed by the main frame 31, the first scroll 32 and the second scroll 33 at the outside of the sealing member 36, and communicates with the compression chamber (V) through a back pressure hole (not shown) provided at the first scroll 32 so that the refrigerant of an intermediate pressure may be filled therewithin, thereby keeping an intermediate pressure. However, a space formed within the sealing member 36 may be filled with a high pressure oil so that it may serve as a back pressure chamber.

The second scroll 33 may include orbiting plate portion 331 (hereinafter, referred to as a "second plate portion" or "second plate"), which may be formed substantially in a disc shape. At an upper surface of the second plate portion 331, the back pressure chamber (Bs) may be formed and at a bottom surface thereof, a second wrap 332 that forms a compression chamber by engaging with the first wrap 323 may be formed. Further, the second plate portion 331 may include at a center thereof a rotational shaft coupling portion 333 to which the eccentric portion 233 of the rotational shaft 23 is rotatably inserted and coupled may be provided.

The rotational shaft coupling portion 333 may be extendedly formed from the second wrap 332 to form an inner end of the second wrap 332. Thus, the rotational shaft coupling portion 333 may be formed at a same plane as and at an overlapped height with the second wrap 332, such that the eccentric portion 233 of the rotational shaft 23 may be disposed at the same plane as and at the overlapped height with the second wrap 332. As a result, a repulsive force and a compression force of the refrigerant may be cancelled out with each other while being applied to the same plane, based on the second plate portion, so that the second scroll 33 may be prevented from being slanted due to the compression and repulsive force.

An outer circumferential part or portion of the rotational shaft coupling portion 333 may be connected to the second wrap 332 to form the compression chamber (V) together with the first wrap 323 in the compression process. The second wrap 332 may be formed in an involute-shape together with the first wrap 323, but may be formed in various forms. For example, the second wrap 332 and the first wrap 323 may be formed in a shape which include a plurality of connected arcs which have different diameters and origins, and an outermost curve may be formed to be in a substantially elliptical shape having a major axis and a minor axis.

A protrusion 328 that protrudes towards an outer circumferential or portion of the rotational shaft coupling portion 333 may be formed around an inner end (a suction end or a start end) of the first wrap 323, and the protrusion 328 may include a contact part or contact 328*a* formed to protrude from the protrusion 328. That is, an inner end of the first wrap 323 may be formed to have a greater thickness than other parts. Thus, a wrap strength of the inner end that receives the largest compression force in the first wrap may be enhanced, and durability may be improved.

At the outer circumferential part of the rotational shaft coupling portion 333 which faces an inner end of the first wrap 323, a concave portion 335 engaging with the protrusion 328 of the first wrap 323 may be formed. At one side of the concave portion 335, an incremental portion 335*a* may be formed, which has a thickness which is incremented from an inner circumferential part or portion to the outer circumferential part of the rotational shaft coupling portion 333 in a direction of the compression chamber (V). This may cause a length of the first compression chamber (V1) just before discharging to be short, resulting in an increase in the compression ratio of the first compression chamber (V1).

At the other side of the concave portion 335, an arc surface 335*b* having the shape of arc may be formed. A diameter of the arc surface 335*b* may be determined by the thickness of an inner end of the first wrap 323 and an orbiting radius of the second wrap 332, and when the thickness of an inner end of the first wrap 323 is increased, the diameter of the arc surface 335*b* is increased. As a result, the thickness of the second wrap around the arc surface 335*b* may be increased so that durability may be secured, and as the compression path is lengthened, the compression ratio of the second compression chamber (V2) may be increased.

An upper end of the rotational shaft 23 may be fixed by tight-fitting to a center of the rotor 22, but its lower end may be coupled to the compression chamber 30 so as to be supported in the radial direction. Thus, the rotational shaft 23 may transmit a rotational force of the motor part 20 to the second scroll 33 of the compression chamber 33. As a result, the second scroll 33 eccentrically coupled to the rotational shaft 23 may perform an orbiting motion with respect to the first scroll 32.

The main bearing 231 may be inserted and supported in the radial direction to the first shaft support hole 312*a* of the main frame 31 at a lower side of the rotational shaft 23, and at a lower side of the main bearing 231, the sub-bearing 232 inserted to the second shaft support hole 326*a* of the first scroll 32 and supported in the radial direction may be provided. Between the main bearing 231 and the sub-bearing 232, the eccentric part 233 inserted and coupled to the rotational shaft coupling portion 333 of the second scroll 33 may be provided.

The main bearing 231 and the sub-bearing 232 may be coaxially provided so as to have a same axial core, and the eccentric part 233 may be formed eccentrically with respect to the main bearing 231 or the sub-bearing 232 in the radial direction. The sub-bearing 232 may be formed eccentrically with respect to the main bearing 231.

An outer diameter of the eccentric part 233 may be smaller than an outer diameter of the main bearing 231, but larger than an outer diameter of the sub-bearing 232 because it is advantageous in coupling the rotational shaft 23 by penetrating through the respective shaft support holes 312*a* and 326*a* and the shaft coupling portion 333. However, when the eccentric part 233 is not formed integrally with the rotational shaft 23, but formed by a separate bearing, it is possible to couple the rotational shaft 23 without forming the outer diameter of the sub-bearing 232 to be larger than the outer diameter of the eccentric part 233.

Further, an oil supply path 234 that supplies oil to each bearing may be formed at an inner part or portion of the rotational shaft 23. As the compression part 30 is located at a lower part or portion of the drive unit 20, the oil supply path 234 may be formed at a substantially intermediate or lower height of the stator 21 at a lower part or portion of the rotational shaft 23, or up to a position which is higher than an upper end of the main bearing 231 in a crosscutting manner.

At a lower end of the rotational shaft 23, that is, at a lower end of the sub-bearing 232, an oil feeder 60 may be coupled to pump oil contained in an oil storage space 10*b*. The oil feeder 60 may include an oil supply tube 61 inserted in and coupled to the oil supply path 234 of the rotational shaft 23, and an oil suction-up member (not shown) which is inserted in the oil supply tube 61 to suction up oil in the form of a propeller. The oil supply tube 61 may be submerged in the oil storage space 10*b* after having passed through the discharge cover 34.

Between each bearing and the eccentric part, or between each bearing, oil feeding holes or oil feeding recesses may be provided so that oil which has been suctioned up through the oil supply path may be supplied to an outer circumferential surface of each bearing and the eccentric part. Thus, oil, which has been suctioned up to an end of the main bearing 231 through the oil supply path 234, oil supply hole (not numbered), oil supply recess (not numbered) of the rotational shaft 23, flows to an outside of a bearing surface from an upper end of the first shaft support 312 of the main frame 31, flows down to an upper surface of the main frame 31 along the first shaft support 312, and then is collected in the oil storage space 10*b* through the oil passage ($P_O$) which is consecutively formed on an outer circumferential surface (or a recess that communicates from an upper surface to an outer circumferential surface) of the main frame 31 and an outer circumferential surface of the first scroll 32.

Moreover, oil, which has been discharged to the inner space 10*a* of the casing 10 from the compression chamber (V) together with refrigerant, may be separated from the refrigerant at an upper space of the casing 10, and collected in the oil storage space 10*b* through a passage formed at an outer circumferential surface of the motor part 20 and the oil passage ($P_O$) formed on an outer circumferential surface of the compression part 30.

At an intermediate portion of the refrigerant suction tube 15, that is, at an outside of the casing 10, an accumulator 70 may be installed to separate liquid refrigerant from the refrigerant which is suctioned from the evaporator 4 of the refrigeration cycle apparatus in a direction of the compressor. The accumulator 70 may be formed in the form of a cylinder having an inner diameter greater than an inner diameter of the refrigerant suction pipe 15 and include a housing 71 to which a cap 72 may be coupled to seal the housing 71. The accumulator 70 may be formed in a unitary body having a smaller inner diameter.

The scroll compressor according to embodiments may be operated as follows.

Figure 7:
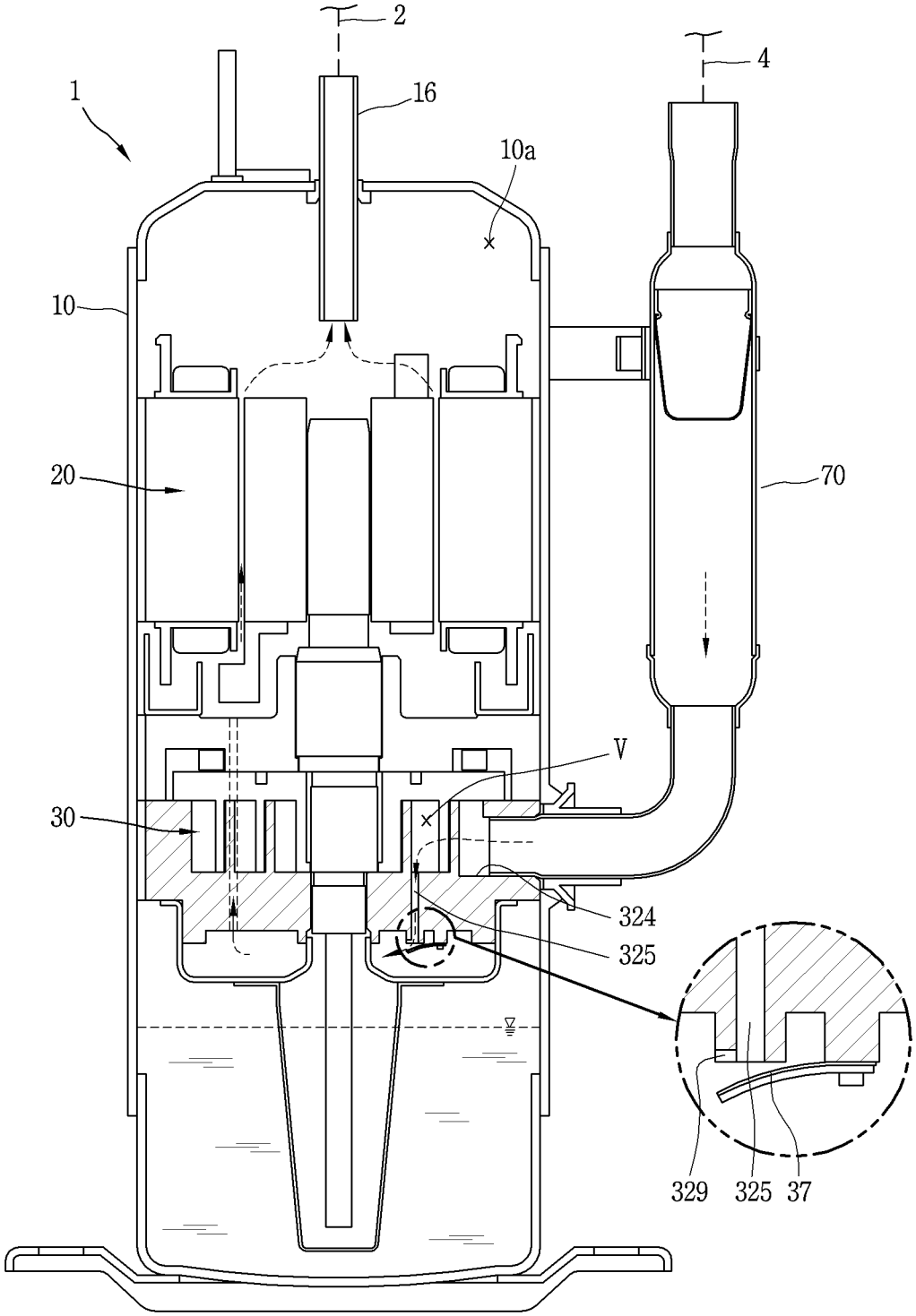
FIG. 7 is a schematic view for explaining a flow state of refrigerant according to an operation of the scroll compressor of FIG. 2.

When power is applied to the motor part 20, a rotational force is generated at the rotor 22 and the rotational shaft 23, and as the rotational shaft 23 is rotated, the second scroll 33 which is eccentrically coupled to the rotational shaft 23 performs an orbiting motion due to the Oldham ring 35. Then, as shown in FIG. 7, refrigerant which has passed through the condenser 2 and the evaporator 4 of the refrigeration cycle apparatus passes a second check valve 80 of the accumulator 70 and flows into the compression chamber (V) through the refrigerant suction pipe 15. The refrigerant is compressed as the volume of the compression chamber (V) is decreased by an orbiting motion of the second scroll 33 and discharged to the inner space 341 of the discharge cover 34 through the discharge port 325.

Then, the refrigerant which has been discharged to the inner space 341 of the discharge cover 34 is circulated within the inner space 341 and moved to a space between the main frame 31 and the stator 21 after noise is decreased, and thereafter moves to an upper space of the motor part 20 through a gap between the stator 21 and the rotor 22.

Then, oil is separated from the refrigerant at an upper space of the motor part 20 and the refrigerant is discharged to outside of the casing 10 through the refrigerant discharge pipe 16, whereas the oil is collected in the oil storage space 10*b* at a lower space of the casing 10 through the oil passage $P_O$ between the inner circumferential surface of the casing 10 and the stator 21 and the oil passage $P_O$ between the inner circumferential surface of the casing 10 and the outer circumferential surface of the compression part 30, and the process is repeatedly performed.

In this instance, when operation of the refrigeration cycle apparatus is stopped, the compressor 1 is stopped so that a compression load within the compression chamber (V) may be removed. However, though the compression load is removed at the compression chamber (V), the refrigerant which has been discharged to the refrigeration cycle from the compressor 1 moves from the condenser 2 maintaining a relatively high pressure to the evaporator 4 maintaining a relatively low pressure by a pressure difference between a suction side and a discharge side based on the compression part 30.

Accordingly, when the condensing fan 2*a* and the evaporating fan 4*a* of the refrigeration cycle apparatus are operated in a state in which the compressor 1 is stopped, that is, the compression load of the compression part 30 is removed, heat exchange may be continuously performed using latent heat while the refrigerant is moved by the pressure difference, thereby enhancing efficiency of the refrigeration cycle apparatus.

However, when a check valve is installed at the discharge port 325 in a high pressure type scroll compressor in which the compression chamber (V) communicate with an inner space 10*a* of the casing 10, high pressure refrigerant which is discharged to the inner space 10*a* of the casing 10 can not flow in the compression chamber (V) due to the check valve when the compressor is stopped. As a result, restart is not possible in a case where a pressure difference between the suction pressure (pressure within the compression chamber) (Ps) and the discharge pressure (pressure within the inner space of the casing) (Pd) is small, and a pressure equilibrium time should be maintained for a long time. However, when the pressure equilibrium time is maintained for a long time, oil leakage may increase, thereby it would not be possible in practice to maintain the pressure equilibrium time for a long time.

Accordingly, the pressure equilibrium time has to be maintained as short as possible, but then the compressor does not reach the pressure equilibrium required to restart, so that the compressor may not be restarted, even though attempts are made to restart the refrigeration cycle apparatus. Moreover, when the pressure equilibrium time is set to be short, energy efficiency is deteriorated because the latent heat in a differential pressure region is not utilized.

Considering this, in embodiments, as shown in FIG. 2, the first check valve 37 is installed at the discharge port 325 which communicates the compression chamber (V) with the inner space 10*a* of the casing 10, and a communicating part or path 329 that communicates the inner space 10*a* (specifically, an inner space of the discharge cover) of the casing 10 with the compression chamber (V) (specifically, discharge port) even in a case where the first check valve 37 is closed, is formed at an exit end of the discharge port 325, such that the high pressure refrigerant which has been discharged to the inner space 10*a* of the casing 10 flows in the discharge port 325 through the communicating part 329 when the compressor 1 is stopped, thereby maintaining the pressure within the compression chamber (V) and within the inner space 10*a* of the casing 10 to be in equilibrium.

For example, the communicating part 329 may be formed in the shape of a recess or dent at a predetermined depth around the exit end of the discharge port 325. The communicating part 329 may be formed to be exposed to outside of the first check valve 37 even in a case where the first check valve 37 is closed. As the communicating part 329 is exposed to outside of the first check valve 37 even in a case where the first check valve 37 is closed, the inner space 10*a* of the casing 10 (inner space of the discharge cover) and the compression chamber (V) may communicate with each other through the communicating part 329. Thus, the refrigerant which has been discharged to the inner space 10*a* of the casing 10 may flow in the compression chamber (V) through the communicating part 329 and the discharge port 325, and the inner space 10*a* of the casing 10 and the compression chamber (V) may be converted into a pressure equilibrium state so that the compressor may be restarted.

The communicating part 329 may be formed at different positions or in different shapes according to a position or shape of the discharge port 325. That is, the discharge port 325 may include a first discharge port 325*a* and a second discharge port 325*b* so as to independently communicate with the first compression chamber (V1) and the second compression chamber (V2), respectively.

In this instance, the first discharge port 325*a* may be configured to communicate with a first communicating part or path 329*a* and the second discharge port 325*b* may be configured to communicate with a second communicating part or portion 329*b*. Thus, the first discharge port 325*a* and the second discharge port 325*b* may be blocked by first check valves 37*a* and 37*b*, but in practice the first discharge port 325*a* and the second discharge port 325*b* may be constantly maintained in at least a partially opened state by the first communicating part 329*a* and the second communicating part 329*b*, respectively.

Figure 4:
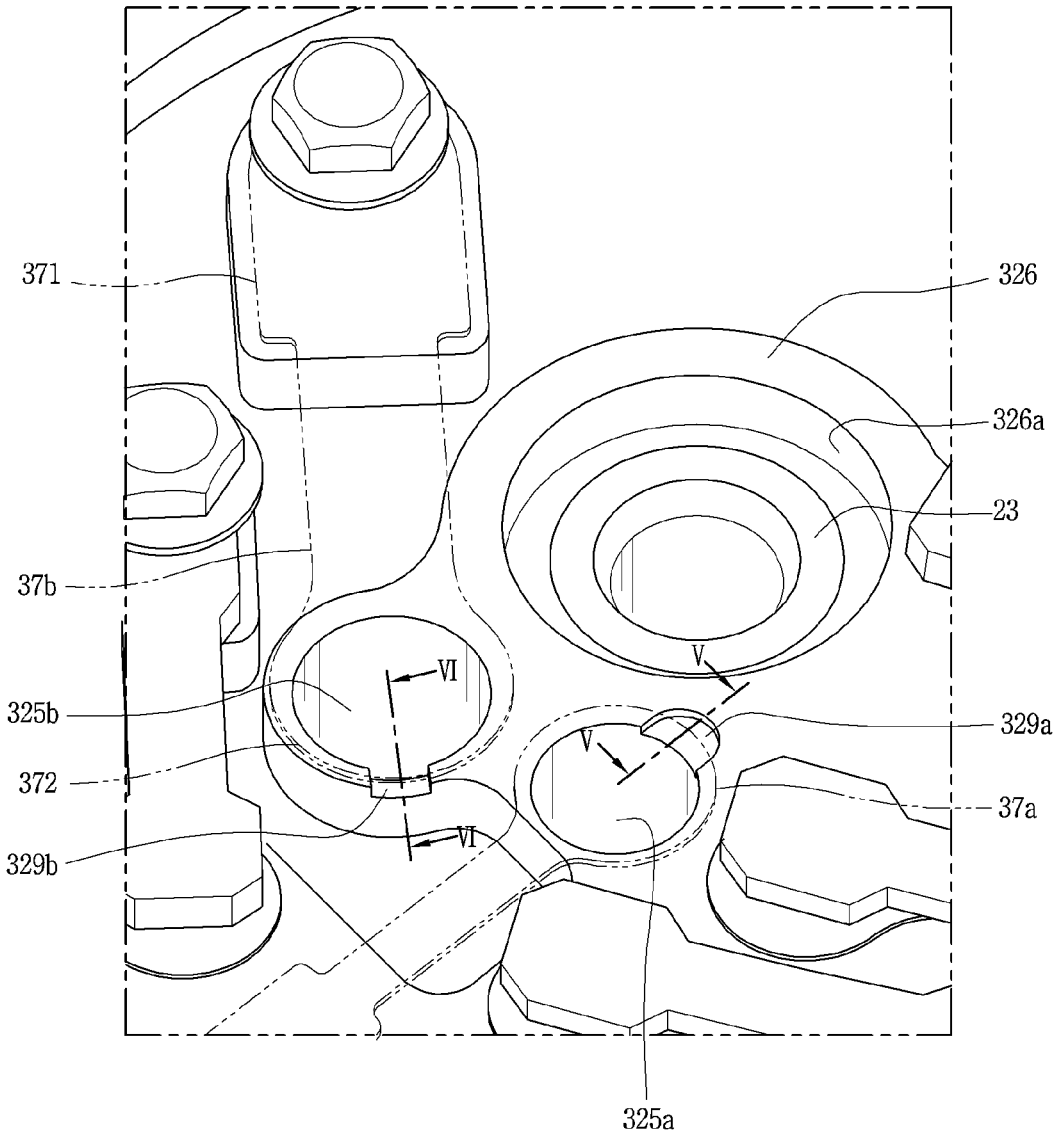
FIG. 4 is a perspective view for explaining a first check valve of FIG. 2.
Figure 5:
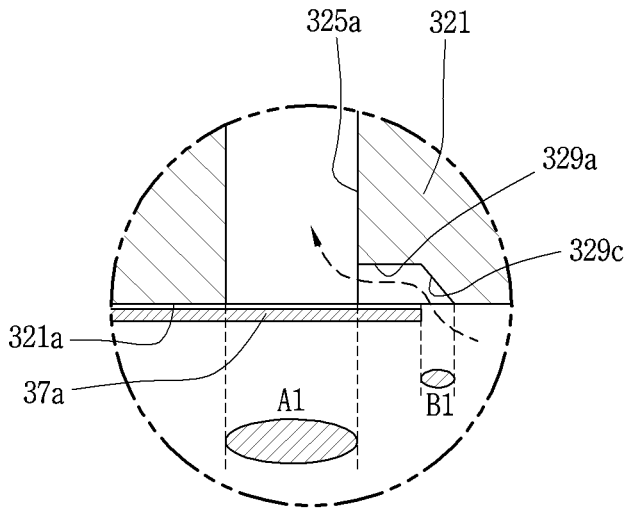
FIGS. 5 and 6 are sectional views taken along the lines "V-V" and "VI-VI" of FIG. 4.
Figure 6:
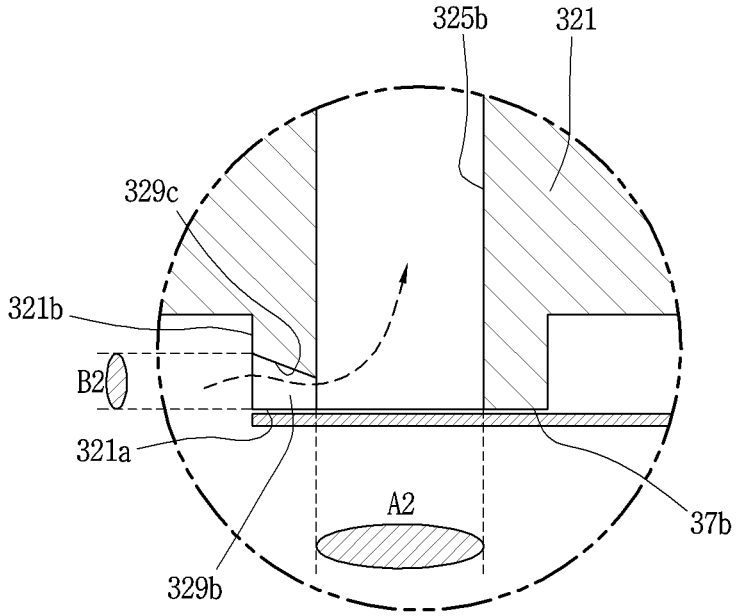

Cross sectional areas of the first and second communicating parts 329*a* and 329*b* may be formed in proportion to cross sectional areas of the first and second discharge ports 325*a* and 325*b*. For example, as shown in FIGS. 4 through 6, when a cross sectional area (A1) of the first discharge port 325*a* is smaller than a cross sectional area (A2) of the second discharge port 325*b*, the first communicating part 329*a* may be formed to have a cross sectional area (B1) smaller than a cross sectional area (B2) of the second communicating part 329*b*. However, when the cross sectional areas of the first and second discharge ports 325*a* and 325*b* are the same, the first and second communicating parts 329*a* and 329*b* may have the same cross sectional areas.

Further, as shown in FIGS. 4 and 5, when the first discharge port 325*a* is formed at a center of a valve seat surface 321*a*, that is, when the first discharge port 325*a* is formed at a wide portion of the valve seat surface 321*a*, the first communicating part 329*a* may be extended from an inner circumferential surface of the first discharge port 325*a* in the radial direction and formed at the valve seat surface 321*a* to have a predetermined area and depth. Further, the first communicating part 329*a* may be formed to have the cross sectional area smaller than a cross sectional area of the first discharge port 325*a* in order to prevent refrigerant from excessively flowing back. Furthermore, as shown in FIGS. 4 through 6, when the second discharge port 325*b* is formed around an edge of the valve seat surface 321*a*, that is, when the second discharge port 325*b* is formed at a protruded and narrow portion of the valve seat surface 321*a*, the second communicating part 329*b* may be formed to communicate between the side surface 321*b* of the valve seat surface 321*a* and an inner circumferential surface of the second discharge port 325*b*.

The second communicating part 329*b* may be formed to have a cross sectional area smaller than a cross sectional area of the second discharge port 325*b* in order to prevent refrigerant from excessively flowing back. Further, in such instances, the first and second communicating parts 329*a* and 329*b* may be formed at a farthest portion from a fixed end 371 of the first check valves 37*a* and 37*b*, that is, at a farthest portion from the fixed end 371 of the first check valves 37*a* and 37*b* between inner surfaces of the first discharge port 325*a* and the second discharge port 325*b*, in a direction of a free end 372 of the first check valves 37*a* and 37*b*.

The first and second communicating parts 329*a* and 329*b* may be provided with a guide surface 329*c* which is inclined from an outside to inside based on the discharge port, such that refrigerant may smoothly flow in the direction of the compression chambers (V1 and V2) within the inner space 10*a* of the casing 10.

Thus, as shown in FIG. 7, each of the first check valves 37*a* and 37*b* may be opened by the pressure of refrigerant compressed in each of the compression chambers (V1 and V2) so that the refrigerant may be smoothly discharged towards the inner space 10*a* of the casing 10 from the compression chamber (V), in a normal operation state of the compressor 1. The refrigerant may flow again in both the compression chambers (V1 and V2) of the compressor 1 through the condenser 2, expander 3, and evaporator 4.

Figure 8:
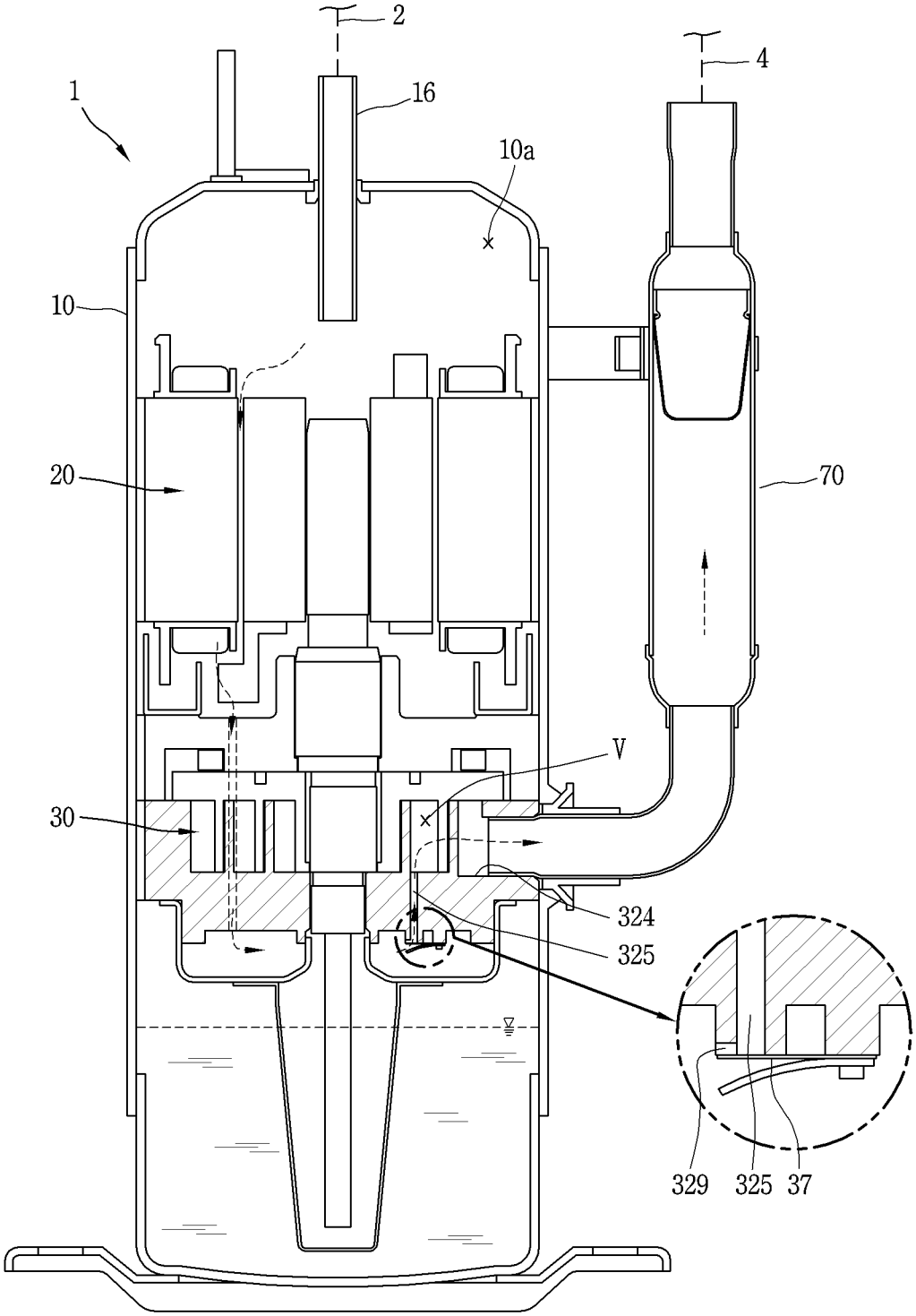
FIGS. 8 through 11 are longitudinal sectional views illustrating other examples of the scroll compressor to which first and second check valves according to an embodiment are applied.

On the other hand, as shown in FIG. 8, when the compressor 1 is stopped, the pressure within each of the compression chambers (V1 and V2) is lowered than that within the inner space 10*a* of the casing 10 so that each of the first check valves 37*a* and 37*b* closes each of the discharge ports 325*a* and 325*b*. However, the refrigerant within the inner space 10*a* of the casing 10 which maintains a relatively high pressure section even though the compressor 1 has stopped, may flow in the compression chamber (V) which is a relatively a low pressure section by flowing back through each of the communicating parts 329*a* and 329*b* and the discharge ports 325*a* and 325*b* even in a case where each of the first check valves 37*a* and 37*b* is closed, thereby reducing the pressure equilibrium time that the pressure within the inner space 10 of the casing 10 and that of the compression chamber (V) are equal to a minimum. Also, it is possible to smoothly perform a restart in a high pressure type scroll compressor in which a refrigerant suction pipe 15 directly communicates with a suction side of the compression chamber (V), and a discharge side of the compression chamber (V) communicates with the inner space 10*a* of the casing 10.

Meanwhile, in a case where the communicating part is formed at the discharge port, as described above, a portion of the refrigerant, which is discharged to the inner space of the casing, may flow back to the compression chamber (V), and the refrigerant flowing back to the compression chamber (V) may flow back towards the evaporator 4 through the refrigerant suction pipe 15 and the accumulator 70, when the compressor 1 is stopped. Then, the refrigerant may not smoothly flow from the condenser 2 to the evaporator 4 so that desired cold or hot air may not be generated, even though the condenser 2 and the evaporator 4 are operated while the compressor 1 is stopped, thereby decreasing efficiency of the refrigeration cycle.

Figure 9:
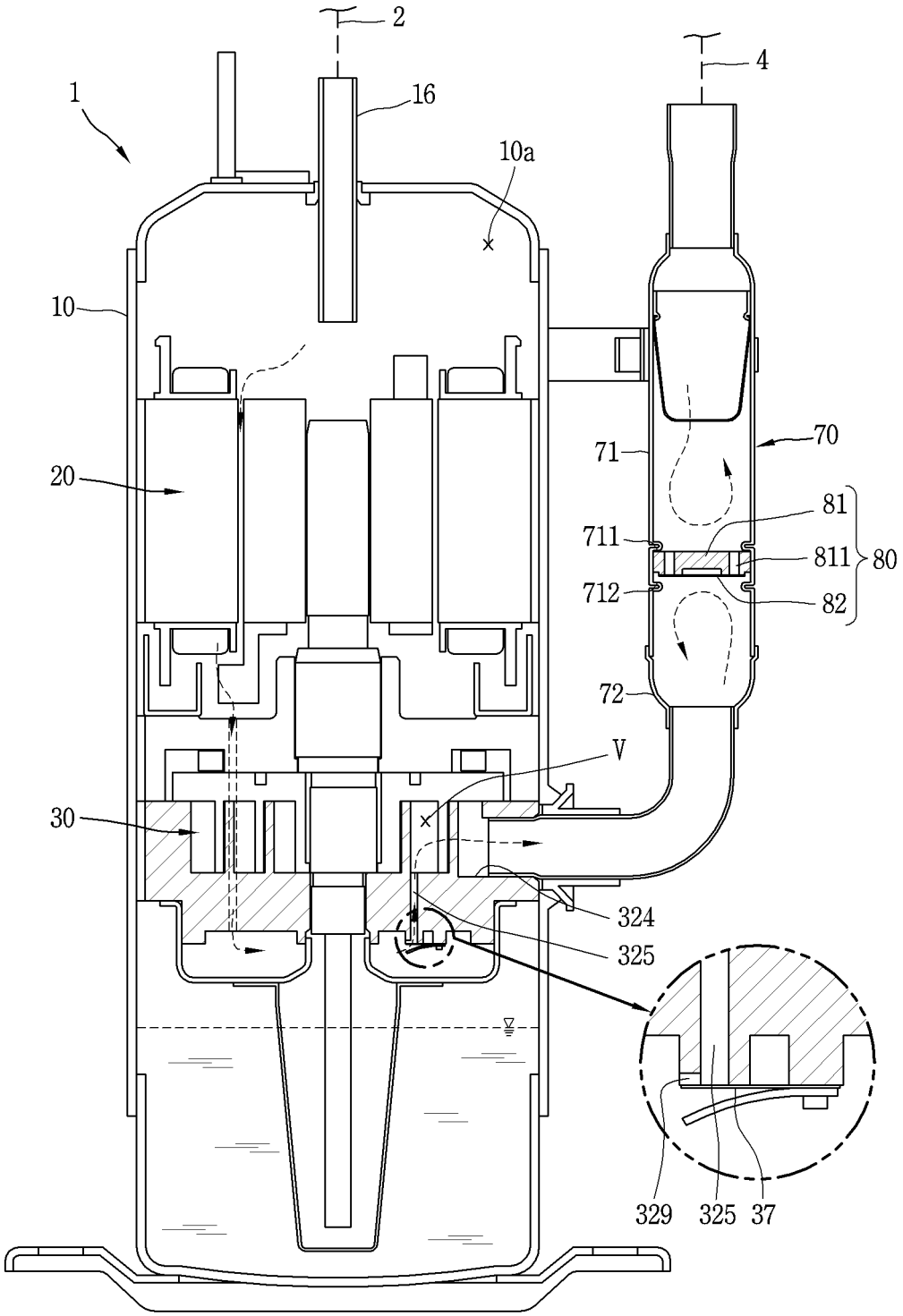

Considering this, as shown in FIG. 9, the second check valve 80 may be installed within the accumulator 70. The second check valve 80 may serve to prevent the refrigerant, which has been flowed back to the compression chamber (V) when the compressor is stopped, from flowing towards the evaporator 4. The second check valve 80 may include a valve plate 81 provided with a refrigerant passing hole 811 and fixed to the accumulator 70, and a valve sheet 82 detachable to the valve plate 81 and configured to selectively close or open the refrigerant passing hole 811.

The valve plate 81 may be fixed to an inner circumferential surface of the housing 71 in a tight-fitting or welding, for example, but the fixing structure is not limited thereto. For example, a rear end of the valve plate 81 facing towards the evaporator 4 may be fixedly supported by a fixing protrusion 711 formed by inwardly bending an edge of the housing 71 of the accumulator 70 so that the valve plate 81 may not be pushed out by the suction or discharge pressure of the refrigerant.

A restriction protrusion 712 may be formed at a lower side of the housing 71, leaving a space through which the valve sheet 82 may be moved from a front side of the valve plate 81. The restriction protrusion 712 may be formed by pressing the housing 71 of the accumulator 70 in a direction of an inner circumferential surface, like the fixing protrusion 711, but may be fixed by, for example, forcedly inserting a separate ring member (not shown) or by welding. Alternatively, the cap 72 may be inserted into the housing 71 so that an end of the cap 72 may serve as a restriction protrusion.

The valve sheet 82 may be formed in a ring shaped plate and may communicate with the refrigerant passing hole 811 of the valve plate 81 through its inner hole (not shown) when it is spaced apart from the valve plate 81.

When the second check valve is installed in the accumulator 70, as described above, it is possible to block a backflow of the refrigerant, which has been flowed back to the compression chamber (V) from the inner space 10*a* of the casing 10 when the compressor 1 is stopped, to the evaporator 4 from the compression chamber (V), and as a result, the refrigerant that remains within the inner space 10*a* of the casing 10 may consecutively move towards the evaporator 4 from the condenser 2. Thus, as the latent heat of the refrigeration cycle apparatus may be sufficiently used by operating the evaporation fan 4*a* and the compression fan 2*a* of the refrigeration cycle apparatus even in a stopped state of the refrigeration cycle apparatus including a compressor 1, it is possible to increase the energy efficiency of the refrigeration cycle apparatus.

Meanwhile, in the above embodiment, a description was given of a high pressure type scroll compressor which is a lower compression type, embodiments are not limited thereto. For example, it may be applicable to a low pressure type scroll compressor which is a lower part compression type.

Figure 10:
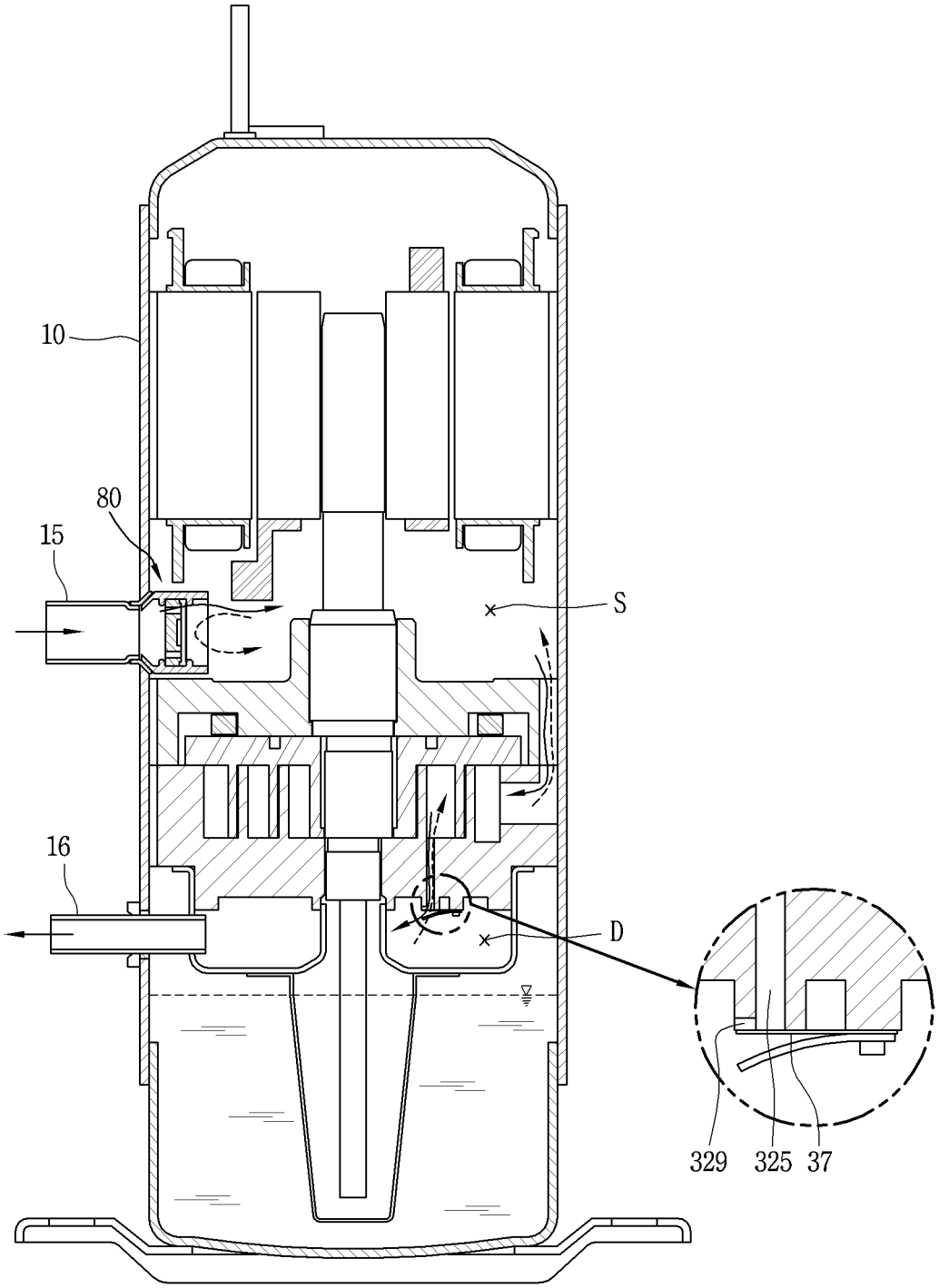

However, in the lower part compression type as well as a low pressure type scroll compressor, as the suction pipe is connected to an inner space of the casing, as shown in FIG. 10, a separate accumulator may not be necessarily provided so that the first check valve 37 may be installed at the discharge port including the communicating part 329 and the second check valve 80 may be installed at an end of the suction pipe 9 within the casing 10.

Thus, when the compressor is stopped, the first check valve 37 is closed, but refrigerant in the discharge space (D) flows back to the compression chamber (V) through the communicating part 329, thereby making it possible to prevent the refrigerant from flowing back towards the evaporator after passing through the suction pipe 15 by the second check valve 80.

Configuration and operation of this embodiment is similar to those of the previous embodiment, and thus, repetitive disclosure has been omitted for simplicity purposes.

Meanwhile, though the description was made of the lower part compression type scroll compressor in the previous embodiments, embodiments are not limited thereto. For example, it will be similarly applicable to the upper part compression type scroll compressor in which the compression part is disposed at an opponent side of the oil feeder based on the motor part.

Figure 11:
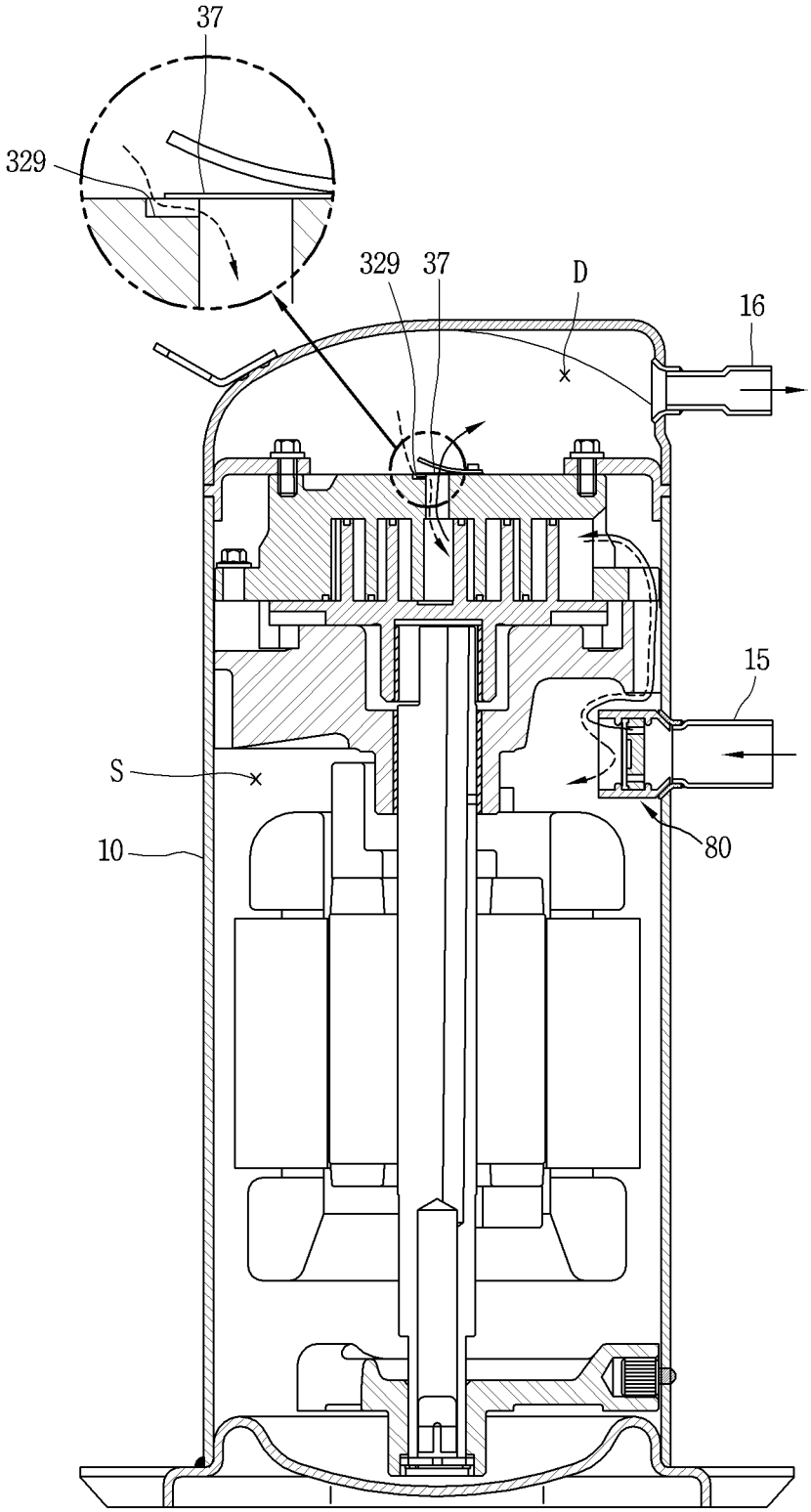

In this instance, the compression method is not limited to a high pressure type, but may be similarly applicable to the low pressure type as well as an upper part compression type scroll compressor. That is, as shown in FIG. 11, the inner space of the casing 10 is divided into a suction space (S) and a discharge space (D), the first check valve 37 is installed at a discharge port including a communicating part, and the second check valve 80 may be installed at an end of the suction pie 15 communicating with the suction space (S) within the suction space (S).

Thus, refrigerant in the discharge space (D) flows back to the compression chamber (V) through the communicating part 329, but it possible to prevent the refrigerant from flowing back towards the evaporator after passing through the suction pipe 15 by the second check valve 80. Configuration and operation of the low pressure type scroll compressor are similar to those of the above described description in the previous embodiment, and thus, repetitive disclosure has been omitted for simplicity purposes.

Embodiments disclosed herein provide a scroll compressor which may be restarted through a rapid pressure equilibrium between an inner space of a casing and a compression part, when a refrigeration cycle apparatus is stopped. Embodiments disclosed herein further provide a scroll compressor capable of increasing efficiency of a refrigerant cycle apparatus through a heat exchange by the refrigerant cycle apparatus while the compressor is stopped.

Embodiments disclosed herein provide a scroll compressor in which a check valve is installed at a discharge side based on the compression chamber, and a refrigerant passage around a discharge port such that the inner space of the casing may communicate with the compression chamber when the compressor is stopped. An accumulator coupled to a suction pipe may be installed outside the casing, and an additional check valve may be further installed within the accumulator.

Embodiments disclosed herein provide a scroll compressor that may include a casing; a drive motor provided in an inner space of the casing; a rotational shaft coupled to the drive motor; a frame provided at a lower side of the drive motor; a first scroll provided at a lower side of the frame and including a first wrap at one side of a first plate portion or plate and a discharge port around an inner end of the first wrap; a second scroll provided between the frame and the first scroll and including a second wrap engaged with the first wrap at one side of a second plate portion or plate to which the rotational shaft is coupled to be overlapped in a radial direction, and a first compression chamber and a second compression chamber provided between the first scroll and the second scroll, while performing an orbiting motion with respect to the first scroll; and a first check valve provided at an exit end of the discharge port and configured to block a backflow of refrigerant discharged to the inner space of the casing to the compression chamber. A communication part or portion may be provided at the exit end of the discharge port to communicate the inner space of the casing with the compression chamber in a state in which the first check valve is closed.

The communication part may be formed around the exit end of the discharge port at a predetermined depth in a recessed form and exposed to outside of the first check valve in a state in which the first check valve is closed. The discharge port may include a valve seat surface protruded at a predetermined height, and the communication part may be formed such that a side surface of the valve seat surface communicates with an inner circumferential surface of the discharge port.

The communication part may be formed to communicate with the discharge port, at a point farthest from a fixed end where the first check valve is fixed to the first scroll. The section area of the communication part may be larger than or the same as that of the discharge port.

The discharge port may include a first discharge port that communicates with a first compression chamber and a second discharge port that communicates with a second compression chamber, and the communication part may include a first communication part that communicates with the first discharge port and a second communication part that communicates with a second discharge port.

A compression ratio of the first compression chamber may be different from that of the second compression chamber, and a sectional area of the first communication part may be different from that of the second communication part. The sectional area of the first discharge port may be smaller than that of the second discharge port, and the sectional area of the first communication part may be smaller than that of the second communication part. The communication part may include a guide surface formed to be slanted towards an inner side from an outer side based on the discharge port.

The compressor may further include a second check valve provided at a suction flow path that communicates with a suction side of the compression chamber and configured to restrict fluid from flowing in a direction towards the suction side from a discharge side based on the compression chamber. The compressor may further include an accumulator that forms the suction flow path and provided at outside of the casing, and the second check valve may be provided within the accumulator and configured to restrict the fluid within the compression chamber from flowing back through the accumulator.

An inner space of the casing may be divided into a suction space connected to the suction pipe and a discharge space connected to the discharge pipe, and the second check valve may be provided within the suction space and configured to restrict the fluid within the suction space from flowing back in a direction of the suction pipe.

Embodiments disclosed herein provide a scroll compressor that may include a first scroll including a first wrap at one side of a first plate portion or plate, and a first discharge port and a second discharge port formed around an inner end of the first wrap to penetrate through the first plate portion in a thickness direction so as to be eccentric to a center of the first plate; a second scroll including a second wrap formed at one side surface of a second plate portion or plate so as to be engaged with the first wrap, a first compression chamber formed between an inner surface of the first wrap and an outer surface of the second wrap while performing an orbiting motion with respect to the first scroll, a second compression chamber formed between an outer surface of the first wrap and an inner surface of the second wrap while performing an orbiting motion with respect to the first scroll, the first compression chamber communicating with the first discharge port and the second compression chamber communicating with the second discharge port, respectively; and a rotational shaft having an eccentric part or portion that is coupled to be penetrated through the second scroll so as to be overlapped with the second wrap in a radial direction. A first check valve may be provided at an exit end of the first discharge port and an exit end of the second discharge port to open or close the first and second discharge ports, respectively, and a first communication part or portion and a second communication part or portion may be provided at the exit end of the first discharge port and the exit end of the second discharge port, respectively, to allow communication between an inner space of a casing and each of the first and second discharge ports in a state that the first check valve is closed. A sectional area of the first discharge port may be smaller than that of the second discharge port, and a sectional area of the first communication part may be smaller than that of the second communication part.

The compressor may further include a second check valve that communicates with the suction hole and provided at a suction flow path that guides refrigerant into the compression chamber, and configured to block a backflow of the fluid within the compression chamber to the suction flow path.

Embodiments disclosed herein provide a scroll compressor that may include a casing; a drive motor provided in an inner space of the casing; a rotational shaft coupled to a rotor of the drive motor and rotating with the rotor; a first scroll provided at the casing; a second scroll engaging with the first scroll to form a compression chamber and coupled to the rotational shaft to perform an orbit motion; a suction port provided at the first scroll and configured to guide refrigerant to the compression chamber; a discharge port provided at the first scroll and communicating with the inner space of the casing such that the refrigerant compressed at the compression chamber is discharged to the inner space of the casing; a first check valve installed at an exit end of the discharge port and configured to block the discharge port when the compressor is stopped; and a communication part or portion provided at an exit end of the discharge port and configured to allow the refrigerant discharged to the inner space of the casing to flow back to the compression chamber in a state that the first check valve blocks the discharge port. The communication part may include a recess formed at a valve seat surface where the first check valve is installed at a predetermined depth and area. The communication part may be formed to have a sectional area smaller than that of the discharge port. The communication part may be formed at an opposite side of a point where the first check valve is fixed to the first scroll.

The compressor may further include a second check valve provided at a suction flow path that communicates with the suction hole to guide refrigerant to the compression chamber and configured to block a backflow of the fluid within the compression chamber to the suction flow path.

According to the scroll compressor in accordance with embodiments, a check valve may be installed at a discharge port and a communication part or portion forming a refrigerant flow path may be formed between the discharge port and the check valve, such that an inner space of a casing and the compression part may communicate with each other to move the refrigerant discharged to the inner space of the casing to the compression chamber, causing an inner space of the compressor to be rapidly in a pressure equilibrium state when the refrigeration cycle apparatus including the compressor is stopped, thereby enabling the compressor to be smoothly restarted. Further, a check valve may be installed at a discharge port of a compression chamber and a communication part may be formed around the discharge port so that flowing of the refrigerant of high pressure that is compressed at the compression chamber towards an evaporator may be prevented, when the compressor is stopped. Thus, the refrigerant may smoothly flow from a condenser to the evaporator so that the refrigeration cycle apparatus may perform a heat exchange while the compressor is stopped, resulting an increase in the efficiency of the refrigeration cycle apparatus.

Further, as the communication part or portion provided at a discharge port of the compression chamber which is opened and closed by a check valve and another check valve is further provided at a suction side of the compression chamber, refrigerant may flow back to the compression chamber from an inner space of the casing when the compressor is stopped, so that the casing and the compression chamber may rapidly reach a pressure equilibrium state, and the refrigerant that flows back to the compression chamber may not flow back in a direction of the evaporator, thereby enhancing the efficiency of the refrigeration cycle apparatus even for a while the compressor is stopped.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Further scope of applicability of embodiments will become more apparent from the detailed description. However, it should be understood that the detailed description and specific examples, while indicating embodiments, are given by way of illustration only, since various changes and modifications within the spirit and scope will become apparent to those skilled in the art from the detailed description.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing including a discharge space provided in an inner space;

a drive motor provided in the inner space of the casing;

a rotational shaft coupled to the drive motor;

a frame provided adjacent to the drive motor;

a first scroll provided adjacent to the frame and including a first wrap at one side of a first plate and a plurality of discharge ports at an inner end of the first wrap;

a second scroll provided between the frame and the first scroll and including a second wrap engaged with the first wrap at one side of a second plate to which the rotational shaft is eccentrically coupled to be overlapped in a radial direction, and a compression chamber formed between the first scroll and the second scroll, while the second scroll performs an orbiting motion with respect to the first scroll; and a plurality of first check valves provided at an exit end surface of an exit end of the plurality of discharge ports and configured to block a backflow of refrigerant discharged to the discharge space of the casing to the compression chamber, respectively, wherein a plurality of recesses is respectively provided at the exit end surface of the plurality of discharge ports to communicate the discharge space of the casing with the compression chamber in a state in which the plurality of first check valves is respectively closed, and wherein the plurality of recesses is formed at the exit end surface of the plurality of discharge ports at a predetermined depth so as to penetrate into an inner circumferential surface of the exit end of the plurality of discharge ports, wherein the compression chamber includes a first compression chamber and a second compression chamber, wherein the plurality of discharge ports includes a first discharge port that communicates with the first compression chamber and a second discharge port that communicates with the second compression chamber, and wherein the plurality of recesses includes a first recess that communicates with the first discharge port and a second recess that communicates with the second discharge port.

2. The compressor of claim 1, wherein the plurality of recesses extends radially from the first discharge port and the second discharge port so as to expose an outside of the plurality of first check valves in a state in which the plurality of first check valves is closed, respectively.

3. The compressor of claim 1, wherein a plurality of valve seat surfaces is respectively formed at the exit end surface of the first discharge port and the second discharge port, and wherein the plurality of recesses is respectively recessed lower than the plurality of valve seat surfaces.

4. The compressor of claim 1, wherein the plurality of recesses is respectively located at a point farthest from a fixed end where the plurality of first check valves is respectively fixed to the first scroll.

5. The compressor of claim 1, wherein a sectional area of the plurality of recesses is smaller than or the same as a sectional area of the plurality of discharge ports, respectively.

6. The compressor of claim 1, wherein a compression ratio of the first compression chamber is different from a communication ratio of the second compression chamber, and wherein a sectional area of the first recess is different from a sectional area of the second-recess.

7. The compressor of claim 6, wherein a sectional area of the first discharge port is smaller than a sectional area of the second discharge port, and wherein the sectional area of the first recess is smaller than the sectional area of the second recess.

8. The compressor of claim 1, wherein at least one of the plurality of recesses includes a guide surface slanted towards an inner side from an outer side based on the first discharge port or the second discharge port.

9. The compressor of claim 1, further comprising a second check valve provided at a suction flow path that communicates with a suction side of the compression chamber and configured to restrict fluid from flowing in a direction towards the suction side from a discharge side based on the compression chamber.

10. The compressor of claim 9, further comprising an accumulator that forms the suction flow path at an outside of the casing, and wherein the second check valve is provided within the accumulator and configured to block a backflow of the fluid within the compression chamber through the accumulator.

11. The compressor of claim 9, wherein an inner space of the casing is divided into a suction space connected to a suction pipe and the discharge space connected to a discharge pipe, and wherein the second check valve is provided within the suction space and configured to block backflow of the fluid within the suction space in a direction of the suction pipe.

12. A scroll compressor, comprising:

a first scroll including a first wrap at one side of a first plate, and a first discharge port and a second discharge port formed at an inner end of the first wrap to penetrate through the first plate in a thickness direction so as to be eccentric to a center of the first plate; and a second scroll including a second wrap formed at one side surface of a second plate so as to be engaged with the first wrap, a first compression chamber formed between an inner surface of the first wrap and an outer surface of the second wrap while performing an orbiting motion with respect to the first scroll, a second compression chamber formed between an outer surface of the first wrap and an inner surface of the second wrap while performing the orbiting motion with respect to the first scroll, wherein the first compression chamber communicates with the first discharge port and the second compression chamber communicates with the second discharge port, respectively, wherein a rotational shaft having an eccentric portion coupled to penetrate through the second scroll overlaps with the second wrap in a radial direction, wherein a plurality of first check valves is respectively provided at an exit end surface of the first discharge port and an exit end surface of the second discharge port to open or close the first discharge port and the second discharge port, respectively, wherein first and second communication paths are provided at the exit end surface of the first discharge port and the exit end surface of the second discharge port, respectively, to allow communication between a discharge space of a casing and each of the first discharge port and second discharge port in a state in which the plurality of first check valves is respectively closed, and wherein the first and second communication paths are formed lower than each of contact surfaces of the plurality of first check valves, respectively.

13. The scroll compressor of claim 12, wherein a sectional area of the first discharge port is smaller than a sectional area of the second discharge port, and wherein a sectional area of the first communication path is smaller than a sectional area of the second communication path.

14. The compressor of claim 12, further comprising a second check valve that communicates with the suction hole and provided at a suction flow path that guides refrigerant into the first and second compression chambers, and configured to block a backflow of the fluid within the first and second compression chambers to the suction flow path.

* * * * *